US007949146B2

(12) United States Patent
McKenzie

(10) Patent No.: US 7,949,146 B2
(45) Date of Patent: May 24, 2011

(54) BOUNDARY LAYER REGULATOR FOR EXTENDED RANGE ACOUSTICAL TRANSDUCERS

(76) Inventor: Mark D. McKenzie, Reynoldsburg, OH (US)

( * ) Notice: Subject to any disclaimer, the term of this patent is extended or adjusted under 35 U.S.C. 154(b) by 1268 days.

(21) Appl. No.: 11/477,027

(22) Filed: Jun. 27, 2006

(65) Prior Publication Data

US 2007/0297638 A1 Dec. 27, 2007

(51) Int. Cl.
*H04R 25/00* (2006.01)

(52) U.S. Cl. ..... 381/343; 381/337; 381/396

(58) Field of Classification Search ..... 381/337, 381/339, 340, 342, 343, 344, 396, 346, 347, 381/405, 407, 432; 181/152, 159, 199
See application file for complete search history.

(56) References Cited

U.S. PATENT DOCUMENTS

| | | | | |
|---|---|---|---|---|
| 2,115,924 A | | 5/1938 | Fisher | |
| 2,124,597 A | | 7/1938 | Tiedje | |
| 2,271,100 A | | 1/1942 | Scott | |
| 2,706,529 A | | 4/1955 | Brittian | |
| 2,808,895 A | | 10/1957 | Chave | |
| 3,016,430 A | | 1/1962 | Hoodwin | |
| 4,157,741 A | * | 6/1979 | Goldwater | 381/342 |
| 5,602,930 A | * | 2/1997 | Walton | 381/396 |
| 5,742,696 A | * | 4/1998 | Walton | 381/340 |
| 6,026,928 A | | 2/2000 | Maharaj | |
| 6,094,495 A | | 7/2000 | Rocha | |

* cited by examiner

*Primary Examiner* — Huyen D Le
(74) *Attorney, Agent, or Firm* — Ruth Eure

(57) ABSTRACT

An improved method and device for controlling cone breakup (divisional modes) in extended range, cone diaphragm type electromechanical acoustical transducers for reproducing an acoustical signal from a corresponding electrical signal is provided. The transducer assembly includes a low mass cone shaped diaphragm, a voice coil former of 30 mm or less in diameter, and a shaped device no wider than the diameter of the voice coil former and extending into the inner volume of the cone but no taller than the height of the outside edge of the cone. This shaped device defines the shape and volume of a small mass of air within the boundary layer of air where molecular adhesion of air molecules to the cone diaphragm surface becomes a significant variable in the performance of the extended range transducer.

9 Claims, 6 Drawing Sheets

BOUNDARY LAYER REGULATOR FOR EXTENDED RANGE ACOUSTICAL TRANSDUCERS

FIELD OF THE INVENTION

The present invention relates to extended range, cone type diaphragm acoustical transducers that accurately reproduce acoustical signals from a corresponding electrical signal.

BACKGROUND OF THE INVENTION

An electromechanical acoustical transducer is a device that converts electrical signals into acoustical signals where a given electrical input mechanically imparts a specific velocity displacement to a mechanical diaphragm whose velocity displacement produces an acoustical signal conveyed to one or more listeners through a transmission medium consisting of a variety of molecular gases commonly called "air." In free space, this assembly of molecular gases (air) shows specific mechanical characteristics as a consequence of molecular cohesion. When approaching a boundary, molecular adhesion of the gas molecules to the boundary surface changes the mechanical characteristics of the gas.

Extended range transducers fail as perfect electrical to acoustical transducers in part because of a variety of unintended material vibration modes within the transducer diaphragm material. The presence of a diaphragm material vibration mode produces a frequency dependent change in the acoustic output magnitude that varies from the corresponding frequency dependent voltage or signal magnitude of the input. One form of this diaphragm material vibration mode often occurs just before a given transducer's high frequency roll-off. This phenomenon is often characterized by a sharp rise in output magnitude just before a precipitous fall-off in acoustical output. One example of this is shown in FIG. 6. This combination of sharp rise preceding a sharp fall-off in acoustical output magnitude is an indicator of what is called diaphragm "breakup."

A variety of devices occupying space on the front side of a cone and within the front side cone volume have been specified. These devices have been variously called diffusers, phase plugs, and compression phase plugs. Generally phase plugs (FIG. 1) have been used with direct radiator acoustical transducers and compression phase plugs have been used with horn type acoustical transducers (FIG. 2).

It is commonly held that both phase plugs and compression phase plugs work according to principles of wave-guide theory. For a direct radiator transducer (FIG. 1) the phase plug operation is described from a ray propagation perspective. A direct radiator phase plug usually has the shape of a cylinder with one end having decreasing radius along a curve until reaching a point at the front side of the plug. The plug 12 is cylindrical until near the front or top edge of the voice coil former and begins its curvature of decreasing radius either slightly below or above this point. This shape of phase plug is usually described as having a bullet shape. Sound generated by the velocity displacement of the cone diaphragm 10 is said to leave the surface of the cone as a ray in a direction perpendicular to the cone surface. This sound ray then strikes the curved portion of the phase plug and the ray is deflected and redirected by interaction with the phase plug's curved surface and is commonly held to thereafter have a direction of propagation parallel to the central axis of the cone.

For a compression type phase plug (FIG. 2), the transducer diaphragm 10 will usually include a dust cap 11 to cover the front edge of the voice coil former and the compression type plug 14 will cover the majority of the cone with a surface profile on the cone side of the plug that follows the cone and dust cap shape profile. There will typically be a complex series of radial slots in the plug. Compression plugs and the slots in the plugs again conform to the principles of wave-guide theory. The function of the slots is commonly held as forming guides that equalize the propagation path length of sound rays emanating from different sections of the cone and dust cap surface such that they leave the exits of the phase plug slots with all rays coincident regardless of point of origin on the varying shape of the diaphragm and dust cap.

While both plug designs have influence upon the performance of the acoustical transducer utilizing them, they are not intended to account for boundary effects and do not produce significant changes in the acoustical output in the range of frequencies considered by this invention. An example of a direct radiator, cone type diaphragm 10 acoustical transducer utilizing a bullet shaped phase plug 12 is shown in FIG. 3. The frequency response produced by the bullet shaped phase plug is shown in FIG. 4. The electrical signal inputted to this transducer has equal energy at all frequencies examined by this test. This response may be compared with the output frequency response shown in FIG. 6. The transducer shown in cutaway side view in FIG. 5 produces the frequency response shown in FIG. 6. This sample has neither phase plug nor dust cap.

As compared to the frequency response performance of the driver of FIG. 5, while there is some improvement in frequency response, the sharp rise and then fall in output magnitude between 10 and 20 kHz is still evident. The wave-guide designed plug of FIG. 3 also causes two small peaks in output magnitude at 6 and 8 kHz and its use may be said to produce a decrease in performance.

SUMMARY OF THE INVENTION

The present invention is a cone style diaphragm type, extended range acoustical transducer for receiving an electrical signal and transmitting an acoustical signal through a transmission medium. An extended range transducer of the type relevant to this invention will include the following parts: a cone style diaphragm 10, a voice coil former 13, a flexible surround 15, a transducer basket frame 16, and a magnet assembly 17. The invention specifically relates to regulating the effect upon the transducer diaphragm by a small volume of air molecularly adhered to the diaphragm surface.

When the acoustical transducer is intended for extended range performance, the transducer is generally small in physical size and using a diaphragm and voice coil former that are also generally small in diameter. Further, the diaphragm material is generally thin and of low mass. When the size of the diaphragm is small, generally less than 120 mm in diameter and the voice coil former is small in diameter, generally 30 mm or less in diameter, then the boundary layer of air adhered to the cone surface can significantly impact the vibrational structure of the diaphragm and effect the acoustical output characteristics. For extended range transducers with cone diameters of less than 120 mm and voice coil diameters less than 30 mm and having thin, low mass diaphragms, the vibrational structure of the diaphragm material may be considered as a compound structure consisting of the diaphragm material and the adhered boundary layer of air.

The embodiment of the invention, hereafter called a boundary layer air mass regulator, is a novel shape of device situated within the inside diameter of the voice coil former. The regulator, consisting of a rigid structure, extends and defines the shape and volume of the adhered boundary air mass in three dimensions.

In its preferred embodiment, the regulator 18 is a plug. The plug comprises a lower portion and an upper portion; wherein the lower portion is essentially a cylinder 19; the upper portion comprises two sections; wherein the lower section of the upper portion comprises a cylinder 20 having a diameter substantially equal to or less than the diameter of the lower portion of the plug and the upper section of the upper portion comprises a cylinder 21 having a diameter substantially equal to or less than the diameter of the lower portion of the plug cutaway side view shape may consist of two stacked cylinders of different radial dimensions. In its preferred embodiment, the regulator as plug comprises a lower portion, wherein the lower portion is essentially a cylinder. The upper portion comprises two sections; wherein the lower section of the upper portion comprises a cylinder having a diameter substantially less that the lower portion of the plug. The upper section of the upper portion comprises a cylinder comprises a cylinder having a diameter substantially equal to the diameter of the lower section of the upper portion. The centers of the upper portions are centered on the central axis of the bottom cylinder. The transitions between the portions and sections of the plug may be abrupt. In side view, the transition in diameter may be right angles to the sides of each cylinder (FIG. 7).

The top of the lower portion of the plug 19 extends the planar dimension of the boundary layer. The sides of the lower 20 and upper 21 sections of the upper portion of the plug partially defines the height of the boundary layer and defines the volume of the adhered air mass. By varying the height of the lower portion and the heights and diameters of the top portions, the combined frequency response of the transducer diaphragm and adhered air boundary layer may be set for high quality performance as shown by the frequency response of FIG. 8.

In the preferred embodiment, the regulator is not acting as a phase plug. It is not a wave-guide and does not redirect sound rays radiated from the sloped surface of the cone to be aligned to propagate all in parallel or parallel with the center axis of the cone. Instead, it sets physical limits or boundaries of the adhered air boundary layer and thereby sets the high frequency response characteristics of the transducer.

DETAILED DESCRIPTION OF THE INVENTION

Preferred Embodiment of the Invention

Figure 7:
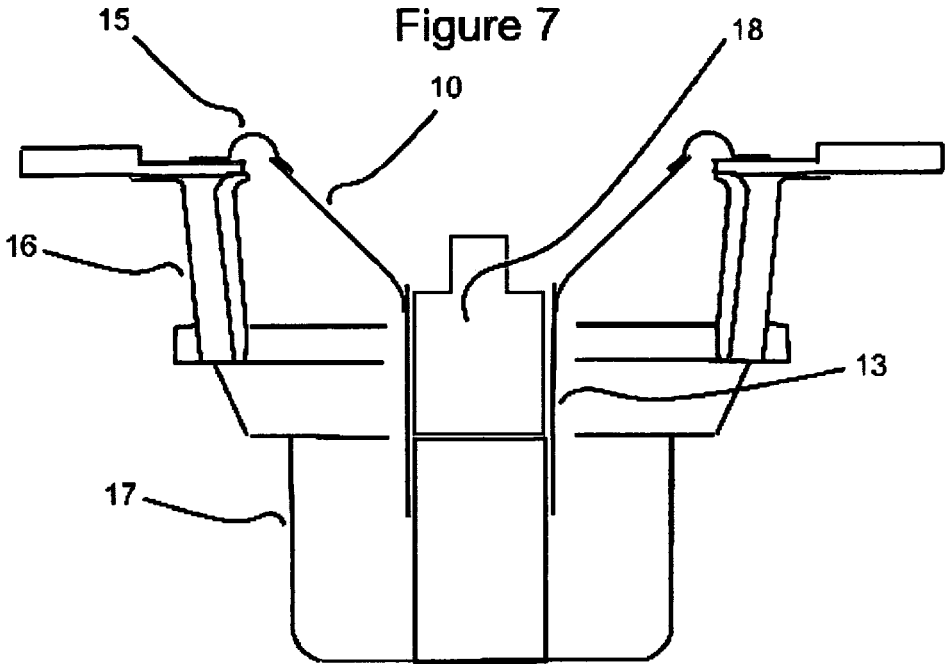
FIG. 7 is a cutaway side view of an extended frequency response cone type diaphragm transducer with boundary zone air mass regulator of the present invention.

The invention is directed to an improved, direct radiator, extended range, cone type diaphragm acoustical transducer. The transducer for the preferred embodiment will have an outside cone diameter of no more than about 120 mm and an outside voice coil diameter of no more than about 30 mm. FIG. 7 shows the preferred embodiment of the invention utilizing an adhered air mass regulator 18 as a plug. The regulator is mounted as a stationary structure inside and separate from the voice coil former 13. The voice coil former 13 and transducer diaphragm 10 move independently of the regulator 18. In its preferred embodiment, the regulator is made of dense and minimally resonant material. Materials suitable for use include any non-ferrous metal, plastic, or wood.

The regulator in its preferred embodiment, as shown in cutaway side view shape of FIG. 7, comprises a lower portion and an upper portion; wherein the lower portion is essentially a cylinder 19; the upper portion comprises two sections; wherein the lower section of the upper portion comprises a cylinder 20 having a diameter substantially less than the diameter of the lower portion of the plug and the upper section of the upper portion comprises a cylinder 21 having a diameter substantially equal to the diameter of the lower portion of the plug has the shape of two stacked cylinders. Two right angles define the transition from the bottom to top cylinder shape of the regulator 17.

The boundary layer of air follows the surface of the transducer diaphragm. This boundary layer is terminated by the surround 15 at the outside diameter of the diaphragm and by the voice coil former 13 at the inside diameter of the diaphragm. The top of the lower portion of the plug 19 extends the boundary layer inward as compared to the old inside terminus of the voice coil former. This precise extension of the inside edge of the boundary layer allows for control of the high frequency extension of the acoustical transducer. The two sections of the upper portion of the plug is dimensioned, both in diameter and in height, to influence the cone vibration mode that produces the sharp rise in acoustical output magnitude above 10 kHz and peaking at 17 kHz. The two sections of the upper portion of the plug sets the boundary layer mass, and the vertical sides of the top cylinder allows the boundary layer to act as a damper to the axial motion of the transducer diaphragm.

Figure 1:
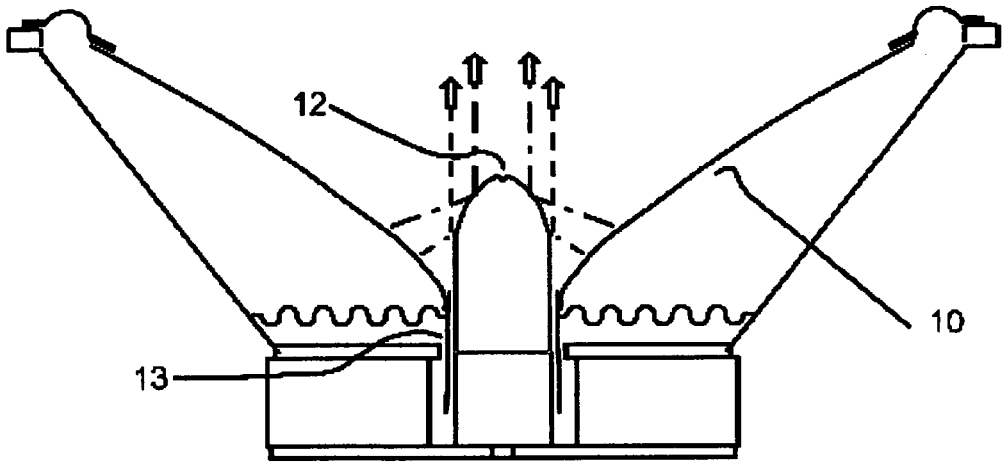
Figure 1 Prior Art
FIG. 1 is a cutaway side view of a typical prior art direct radiator cone type diaphragm acoustical transducer featuring a "phase plug" designed according to wave-guide principles.
Figure 2:
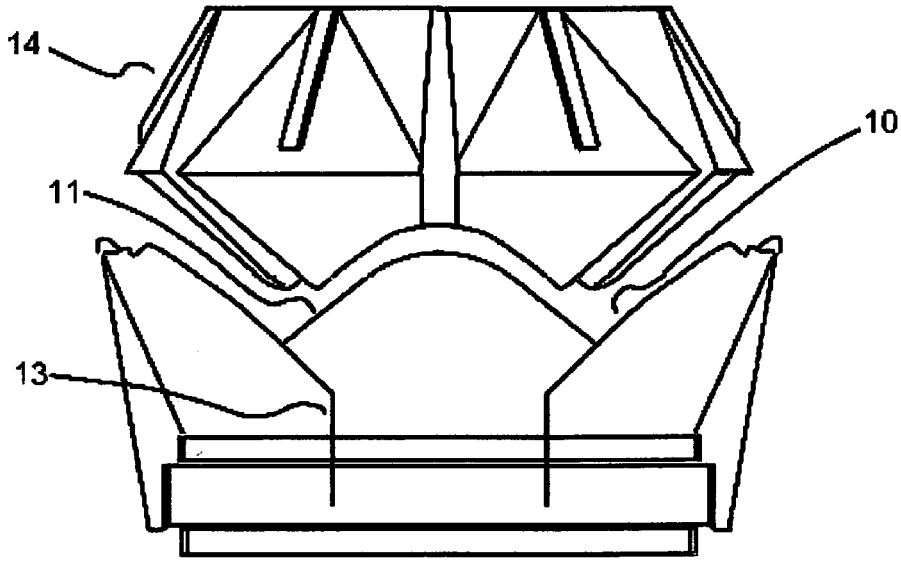
Figure 2 Prior Art
FIG. 2 is a cutaway side view of a typical prior art horn loaded cone type diaphragm acoustical transducer featuring a dust cap and compression phase plug designed according to wave-guide principles
Figure 3:
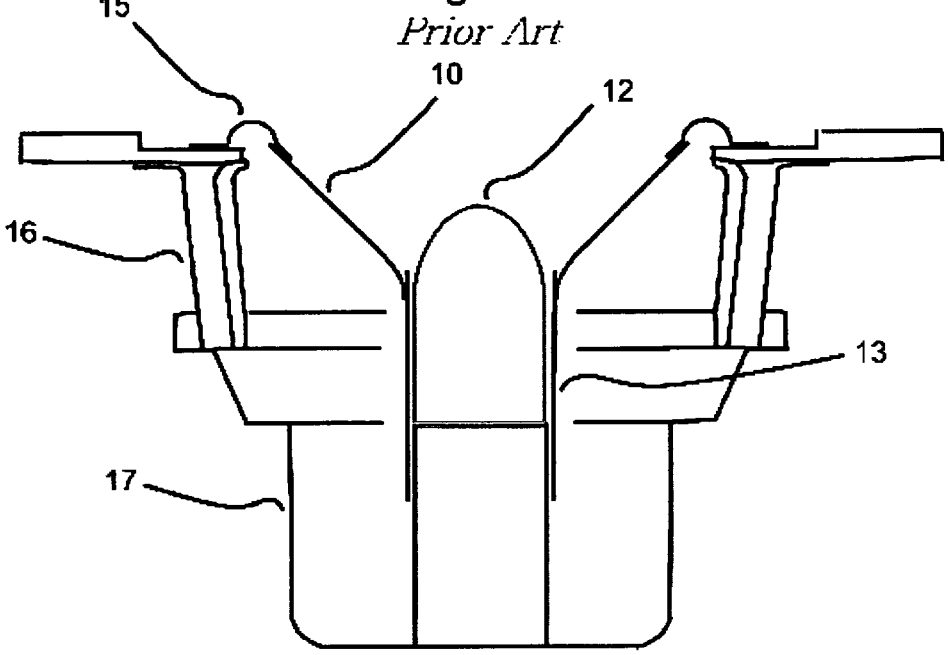
Figure 3 Prior Art
FIG. 3 is a cutaway side view of a prior art extended frequency response cone type diaphragm direct radiator with "bullet" shaped "phase plug."
Figure 4:
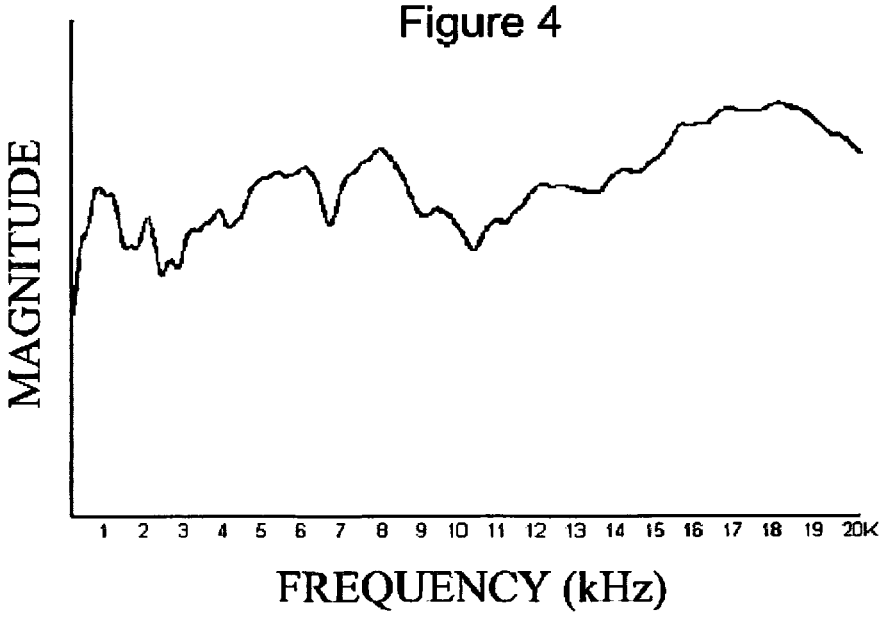
FIG. 4 shows the frequency response graph of the transducer shown in FIG. 3.
Figure 5:
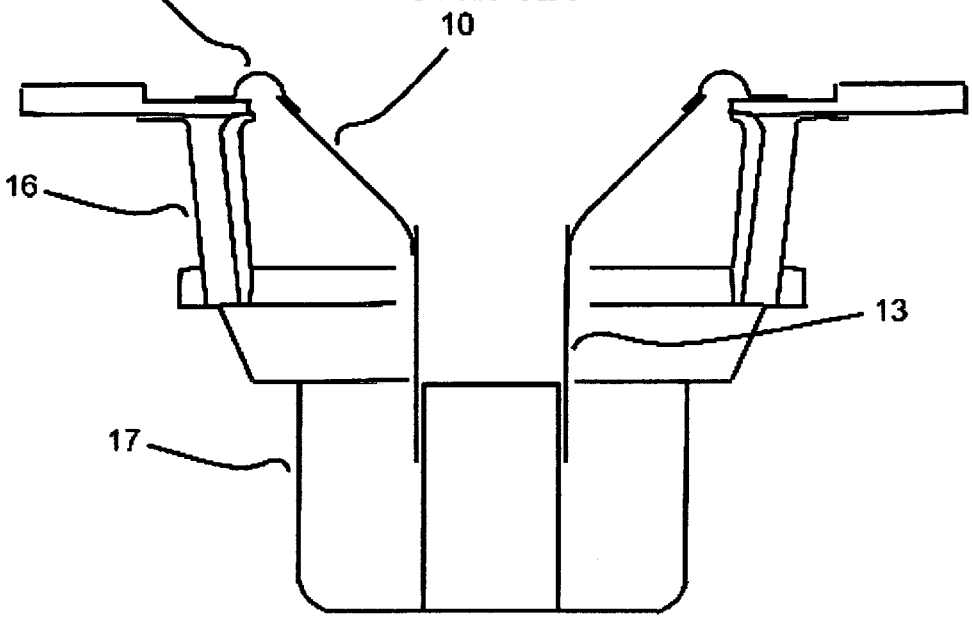
Figure 5 Prior Art
FIG. 5 is a cutaway side view of the prior art extended frequency response cone type diaphragm transducer without plug or dust cap
Figure 6:
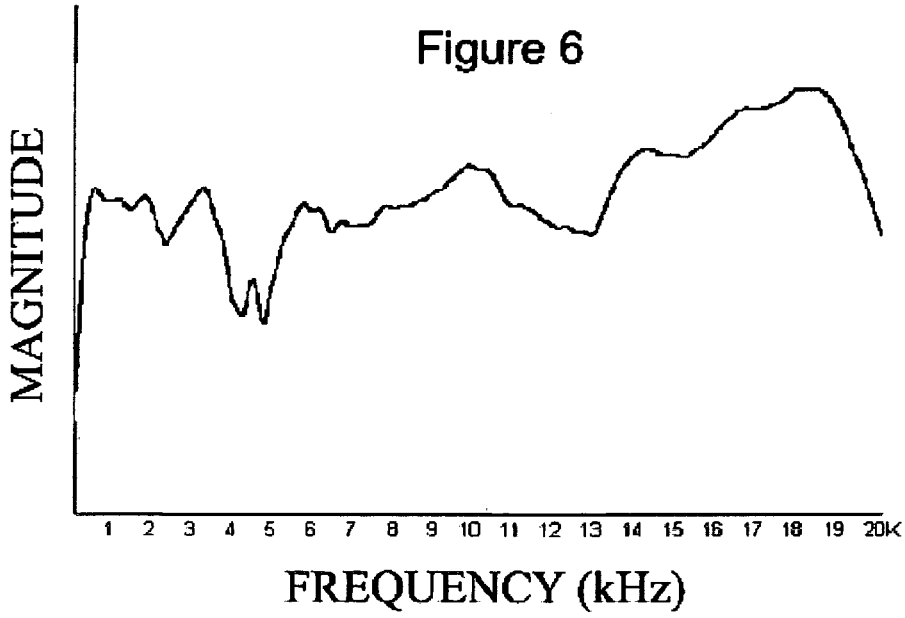
FIG. 6 shows the frequency response graph of the transducer shown in FIG. 5.
Figure 8:
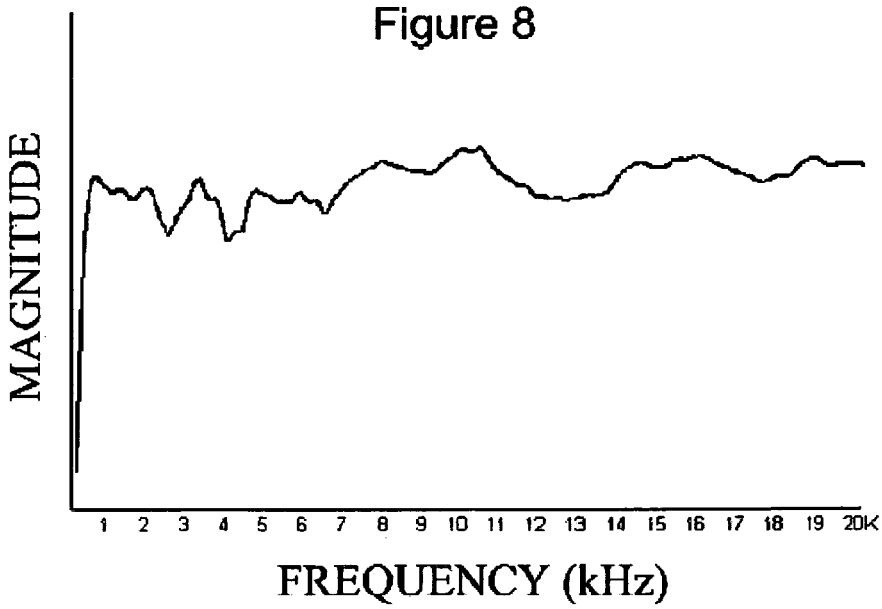
FIG. 8 shows the frequency response graph of the FIG. 7 transducer.

FIG. 8 shows the frequency response graph of the combined cone diaphragm and adhered air mass boundary layer when defined by the air mass regulator. The cone breakup peak at 17 kHz is gone and there is now no roll-off in high frequency output before the test limit of 20 kHz. The additional peaks at 6 and 8 kHz, shown in FIG. 4, caused by the prior art "bullet" shaped phase plug are also not present.

Figure 9:
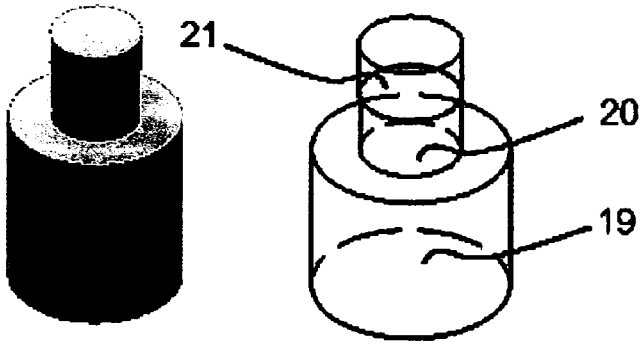
FIG. 9*a* shows the slightly above side 3D view (both solid and wire frame) of the preferred shape for the boundary zone air mass regulator of the present invention as a plug.
FIG. 9*b* shows the slightly above side 3D views (both solid and wire frame) of the preferred shape for the boundary zone air mass regulator of the present invention as a dust cap.
FIG. 9*c* shows the slightly above side 3D view (both solid and wire frame) of the boundary zone air mass regulator of the present invention wherein the upper section of the upper portion describes a disc.
FIG. 9*d* shows the slightly above side 3D view (both solid and wire frame) of the boundary zone air mass regulator of the present invention wherein the upper section of the upper portion describes a truncated cone.
FIG. 9*e* shows the slightly above side 3D view (both solid and wire frame) of the boundary zone air mass regulator of the present invention wherein the upper section of the upper portion describes a cone.
Figure 9:
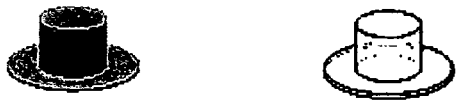
Figure 9:
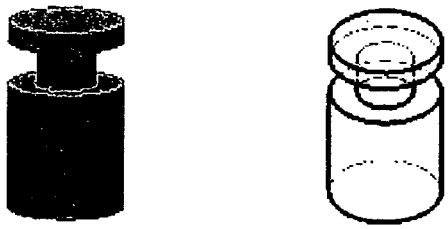
Figure 9:
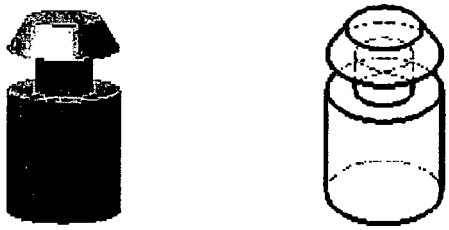
Figure 9:
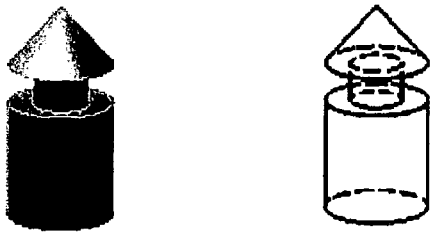

FIG. 9 shows five possible shapes for the preferred and alternate embodiment of the adhered air mass regulator of the present invention.

Alternative Embodiment of the Invention

Figure 10:
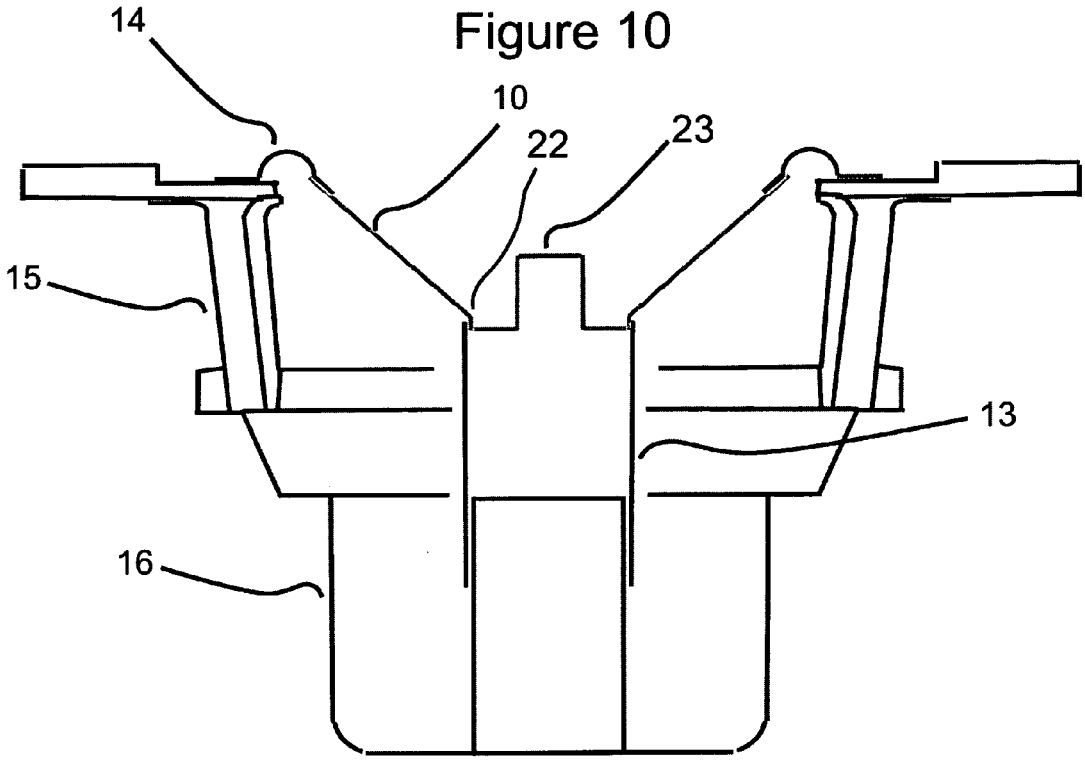
FIG. 10 is a cutaway side view of an extended frequency response cone type diaphragm transducer wherein the boundary zone air mass regulator is part of the cone type diaphragm.

FIG. 10 shows an alternative embodiment of the invention. The critical molecular adhesion surfaces provided by the regulator shape may be provided by either a plug as described in the preferred embodiment or they may be molded into the inner section of a cone 22 or molded into a dust cap 23 attached to the voice coil former.

While the operation of the invention in the alternative embodiment is identical to the preferred embodiment, making the invention an integral part of the cone shape or molded into a dust cap attached to the voice coil former will increase the moving mass and introduce more complex material vibration mode structures into the combined cone or cone and dust cap structure. These added variables will increase the design complexity of the acoustical transducer and generally produce inferior performance as compared to the preferred embodiment.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed:

1. A loudspeaker transducer for receiving an electrical signal and transmitting an acoustical signal through a transmission medium, wherein said acoustical signal is representative of said electrical signal, and wherein said transducer comprises:

a) a cone type direct radiating diaphragm further comprising a voice coil former having a top inside diameter and a top outside diameter and a bottom inside diameter and a bottom outside diameter, all of said diameters being disposed uniformly about a central axis;

b) a transducer cone type diaphragm having an inside diameter and an outside diameter disposed uniformly about the central axis, wherein the inside diameter of the transducer cone diaphragm is firmly attached to the top outside diameter of the voice coil former, and c) a surround, comprising a flexible suspension member having an inside diameter and an outside diameter disposed uniformly about the central axis, with the inside diameter being attached to the outside diameter of the transducer cone type diaphragm, and d) a transducer basket frame uniformly disposed about the central axis and encircling the surround, further encircling the transducer cone type diaphragm, and further encircling the voice coil former, the transducer basket frame further attached to the outside diameter of the surround allowing for motion of the transducer cone type diaphragm and voice coil former relative to the stationary transducer basket frame, and e) a plug fixedly mounted within the top inside diameter of the voice coil former with respect to the transducer cone type diaphragm and voice coil former, thus allowing independent motion of the voice coil former and the cone type diaphragm with respect to the transducer basket frame and plug; and f) a boundary layer air mass regulator, g) wherein the boundary layer air mass regulator is a plug, and further wherein h) the plug comprising the boundary layer air mass regulator further comprises a lower portion and an upper portion; wherein the lower portion is essentially a cylinder; the upper portion comprises two sections; wherein the lower section of the upper portion comprises a cylinder having a diameter substantially equal to or less than the diameter of the lower portion of the plug and the upper section of the upper portion comprises a cylinder having a diameter substantially equal to or less than the diameter of the lower portion of the plug.

2. The transducer of claim 1 wherein the height of the lower portion comprising a cylinder can be varied.

3. The transducer of claim 1 wherein the height and diameter of the sections comprising the upper portion comprising cylinders can be varied.

4. The transducer of claim 1 wherein both the height of the lower portion comprising a cylinder and the height and diameter of the sections comprising the upper portion comprising cylinders can be varied.

5. The transducer of claim 1 wherein the upper section of the upper portion describes a disc.

6. The transducer of claim 1 wherein the upper section of the upper portion describes a truncated cone.

7. The transducer of claim 1 wherein the upper section of the upper portion describes a cone.

8. The transducer of claim 1 wherein the diaphragm is made of paper, plastic, or metal.

9. The transducer of claim 1 wherein the plug is made of wood, plastic, or metal.

* * * * *